US006109859A

United States Patent [19]

Domann

[11] Patent Number: 6,109,859

[45] Date of Patent: Aug. 29, 2000

[54] APPARATUS FOR GRASPING ODD-SHAPED OBJECTS

[76] Inventor: Dennis L. Domann, 15632 U.S. Hwy. 59, Valley Falls, Kans. 66088

[21] Appl. No.: 09/250,673

[22] Filed: Feb. 16, 1999

[51] Int. Cl.[7] ..... B66C 1/00

[52] U.S. Cl. ..... 414/729; 294/67.22; 414/724

[58] Field of Search ..... 414/729, 621, 414/622, 659, 724; 294/67.22, 88, 104

[56] References Cited

U.S. PATENT DOCUMENTS 3,164,405 1/1965 Lull ..... 294/67.22

*Primary Examiner*—Donald W. Underwood
*Attorney, Agent, or Firm*—Flanagan & Flanagan; John K. Flanagan; John R. Flanagan

[57] ABSTRACT

An apparatus for grasping odd-shaped objects to relocate the same includes an upright main frame being attachable to a material handling vehicle for maneuvering the main frame between different heights and locations by operation of the material handling vehicle, a support member mounted at a lower end of the main frame and being adapted to engage an edge of an object, an arm member mounted at an upper end of the main frame so as to undergo pivotal movement relative to the main frame, a tine mounting member mounted to the arm member so as to undergo pivotal movement relative to and independently of the arm member, a pair of tines each having a substantially curved configuration and being mounted to and extending outwardly and downwardly from the tine mounting member, and main and auxiliary actuation mechanisms for respectively pivotally moving the arm member relative to the main frame and the tines relative to the arm member through respective first and second arcuate paths toward and away from the support member and an object between the tines and support member such that the tines and support member together may grasp the object for relocating the object upon maneuvering of the apparatus by operation of the material handling vehicle.

20 Claims, 3 Drawing Sheets

APPARATUS FOR GRASPING ODD-SHAPED OBJECTS

BACKGROUND OF THE INVENTION

1. Field of the Invention

The present invention generally relates to devices for moving objects and, more particularly, is concerned with an apparatus for grasping odd-shaped objects to relocate the same.

2. Description of the Prior Art

Landscaping and building materials can be oddly shaped, awkward and heavy. Objects may be piled together. It is often difficult to remove individual objects of a pile without disturbing other objects in the pile. Equipment may also be damaged in the process of moving objects from one location to another location. An object itself may be damaged in the process of being moved. It is also difficult to place objects precisely where desired.

Various devices have been developed over the years to more effectively move objects, such as landscaping and building materials. Some representative examples of such prior art devices are disclosed in U.S. Pat. No. 2,717,704 to Pilch, U.S. Pat. No. 2,870,925 to Bernad et al., U.S. Pat. No. 2,908,409 to Hinders et al., U.S. Pat. No. 3,817,567 to Lull, U.S. Pat. No. 4,131,210 to Everson, U.S. Pat. No. 4,285,628 to Jankowski, U.S. Pat. No. 4,466,494 to Hanson, U.S. Pat. No. 4,516,896 to Freebery, U.S. Pat. No. 4,808,062 to Bare and PCT CH89/00027 to Ruf. While these prior art devices may be satisfactory in operation under the specific conditions for which they were designed, none of them seem to provide an effective solution for the problems at hand.

Consequently, a need still exists for an apparatus which provides a solution to the aforementioned problems in the prior art without introducing new problems in place thereof.

SUMMARY OF THE INVENTION

The present invention provides an apparatus for grasping odd-shaped objects designed to satisfy the aforementioned need. The object grasping apparatus of the present invention is preferably provided as an attachment for fitting to a material handling vehicle which allows an operator of the vehicle to remove an individual object from a pile without disturbing other objects in the pile. The apparatus can be used to move individual objects without damaging equipment or the object itself. The apparatus allows for easy relocation and placement of objects precisely where desired.

Accordingly, the present invention is directed to an apparatus for grasping odd-shaped objects which comprises: (a) an elongated upright main frame having opposite upper and lower ends, the main frame being attachable to a material handling vehicle for maneuvering the main frame between different heights and locations by operation of the material handling vehicle; (b) a support member mounted to the main frame adjacent to the lower end thereof and being adapted for engaging an edge of an object; (c) an arm member mounted to the main frame adjacent to the upper end thereof so as to undergo pivotal movement relative to the main frame; (d) a tine mounting member mounted to the arm member so as to undergo pivotal movement relative to and independently of the arm member; (e) at least one tine having a substantially curved configuration and being mounted to and extending outwardly and downwardly from the tine mounting member; and (f) means for respectively pivotally moving the arm member relative to the main frame and the tine relative to the arm member through respective first and second arcuate paths toward and away from the support member and an object between the tine and support member such that the tine and support member together may grasp the object for relocating the object upon maneuvering of the apparatus by operation of the material handling vehicle. The apparatus preferably comprises a pair of the tines being spaced apart from one another and mounted to and extending outwardly and downwardly from the tine mounting member. The tines preferably extend in substantially parallel relationship to one another.

More particularly, the pivotally moving means includes a main actuation mechanism and an auxiliary actuation mechanism. The main actuation mechanism is mounted to the main frame and to the arm member and is extendable and retractable to pivotally move the arm member and tines therewith vertically through the first arcuate path relative to the main frame toward and away from the support member and an object disposed between the arm member and the support member. The auxiliary actuation mechanism is mounted to the arm member and to the tine mounting member and is extendable and retractable to pivotally move the tine mounting member and tines therewith vertically through the second arcuate path relative to the arm member toward and away from the support member and the object between the tines and the support member.

Also, the support member includes an upright portion and a base portion. The upright portion is mounted to the main frame and disposed in a transverse relationship thereto adjacent to the lower end of the main frame. The base portion is attached to the upright portion and extends outwardly therefrom so as to provide the support member in a generally L-shaped configuration in cross-section such that the upright portion can be placed against an edge of the object to be grasped and the base portion can be placed under the edge of the object to be lifted.

Further, the main frame has opposite lateral sides. The arm member has a pair of interconnected links disposed in substantially parallel relation to and spaced apart from one another. Each link has opposite outer and inner ends and is pivotally mounted at the inner end to one of the opposite lateral sides of the main frame at a location closer to the upper end than to the lower end of the main frame. The tine mounting member is pivotally mounted to the outer ends of the links of the arm member.

The apparatus further comprises a pair of upper and lower coupling members. The lower coupling member is fixedly mounted to the main frame at a location slightly higher than and on an opposite side of the main frame from the support member. The upper coupling member is spaced above the lower coupling member and fixedly mounted to the main frame at a location between and spaced from the lower and upper ends of the main frame. The upper and lower coupling members are adapted for attaching the apparatus to a lift mechanism of the material handling vehicle.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
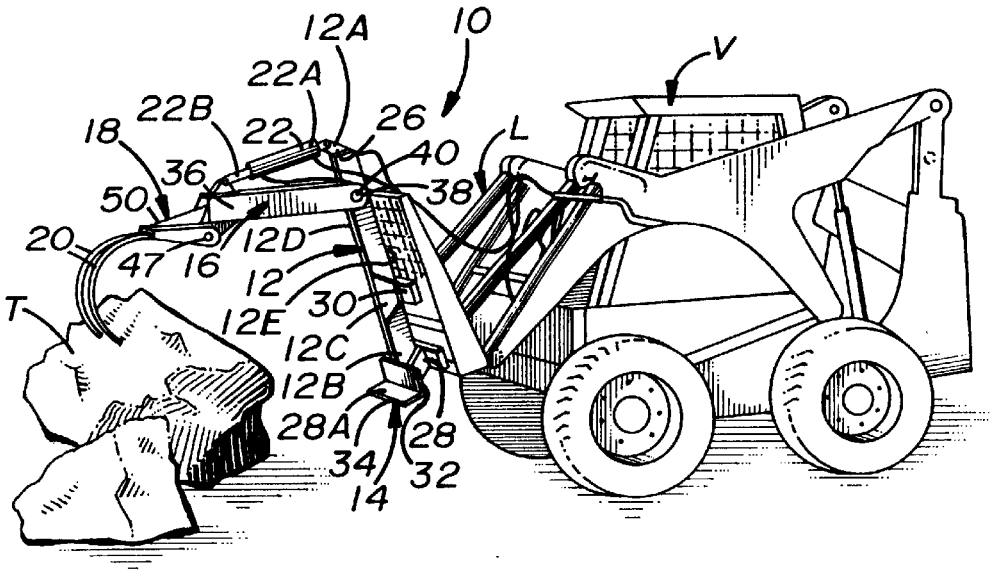
FIG. 1 is a perspective view of the odd-shaped object grasping apparatus of the present invention shown mounted to a lift or loader mechanism of a material handling vehicle and being maneuvered into a position for grasping an odd-shaped object.
Figure 2:
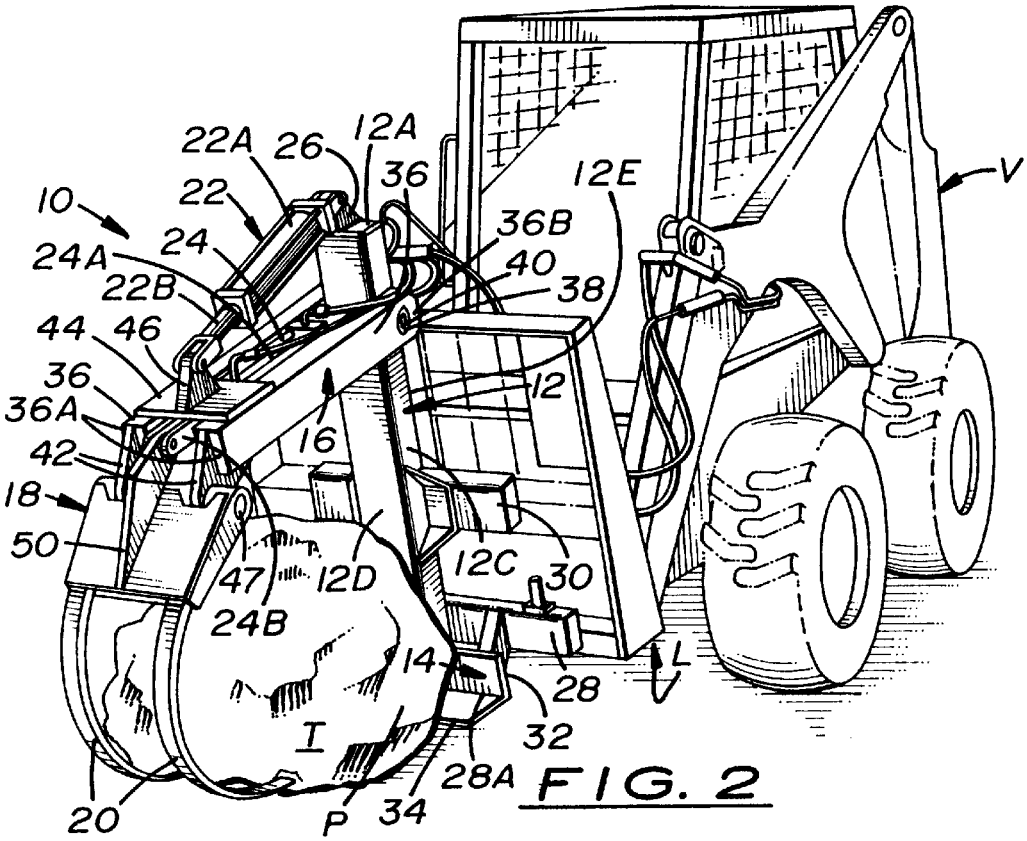
FIG. 2 is another perspective view of the apparatus showing an object grasped between a support member and pair of tines of the apparatus.

Referring to the drawings and particularly to FIGS. 1 and 2, there is illustrated a material handling vehicle V with a front end loader or lift mechanism L supporting an odd-shaped object T grasping apparatus, generally designated 10, of the present invention. Although not so limited, the apparatus 10 is particularly adapted for use in relocating odd-shaped objects T, such as large rocks and railroad ties, by lifting, moving and precisely placing the same. Basically, the grasping apparatus 10 includes an elongated upright main frame 12, a shoe or support member 14, an arm member 16, a tine mounting member 18, at least one and preferably a pair of tines 20, and actuating means preferably in the form of a first or main actuation mechanism 22 and a second or auxiliary actuation mechanism 24.

Referring to FIGS. 1 to 6, the upright main frame 12 of the apparatus 10 includes opposite upper and lower ends 12A, 12B, and opposite lateral sides 12C and opposite front and rear sides 12D, 12E extending longitudinally between the opposite upper and lower ends 12A, 12B. The main frame 12 has a mounting tab 26 attached at the upper end 12A thereof and projecting upwardly and forwardly therefrom. By way of example only, the main frame 12 can be in the form of an elongated hollow tube having a substantially rectangular configuration in longitudinal and transverse cross-sections and measuring four by six inches in cross section. The length of the main frame 12 is substantially greater than the widths thereof.

Figure 4:
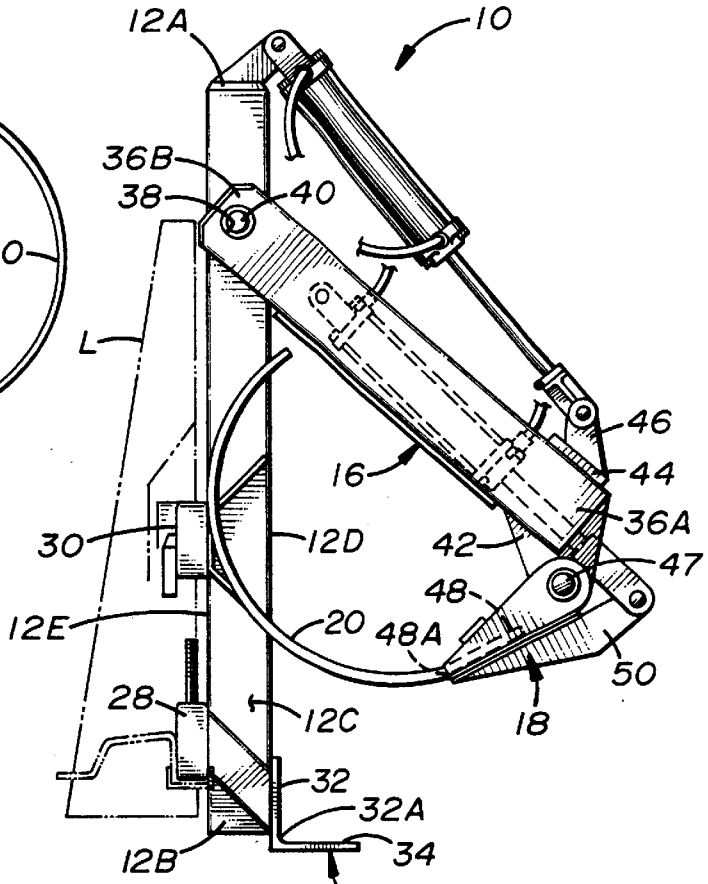
FIG. 4 is a side elevational view of the apparatus with the arm and tines of the apparatus being shown in closed positions.
Figure 3:
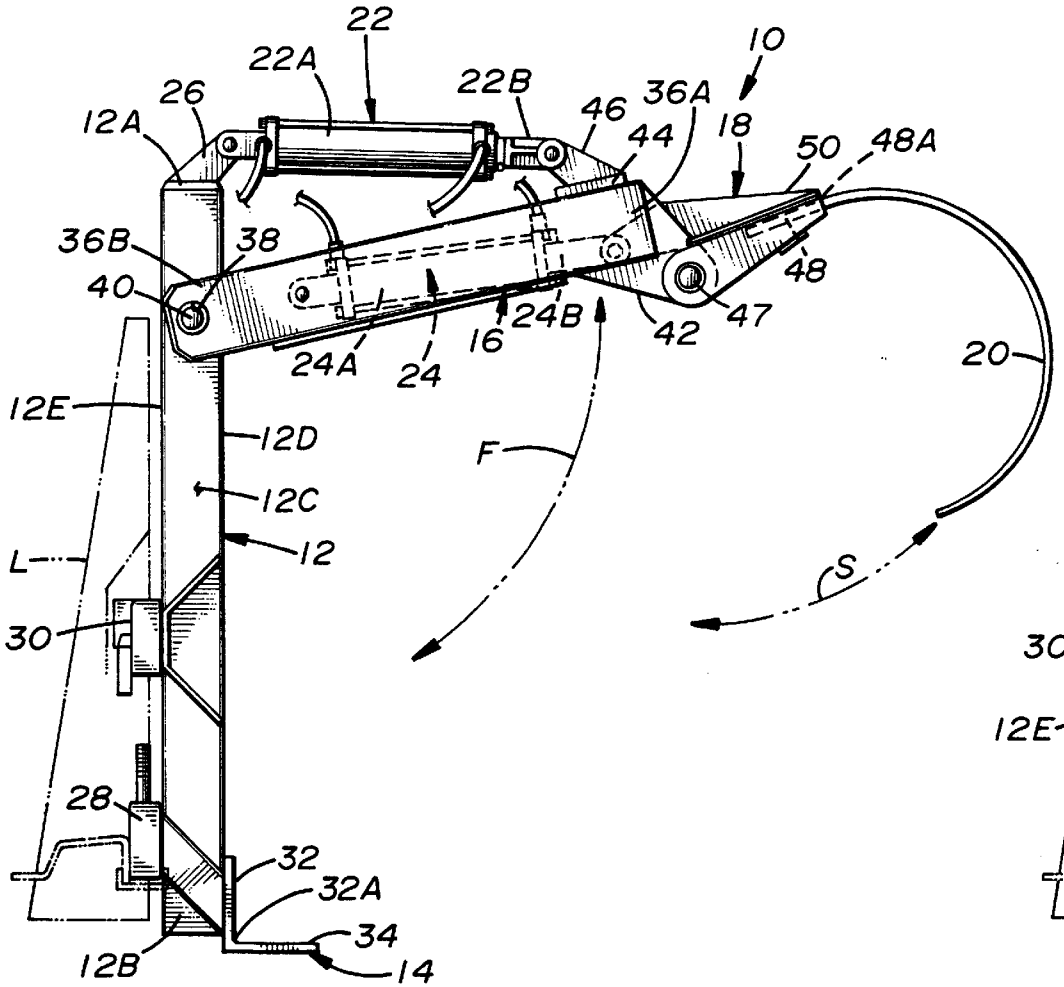
FIG. 3 is a side elevational view of the apparatus with an arm member and tines of the apparatus being shown in opened positions.
Figure 5:
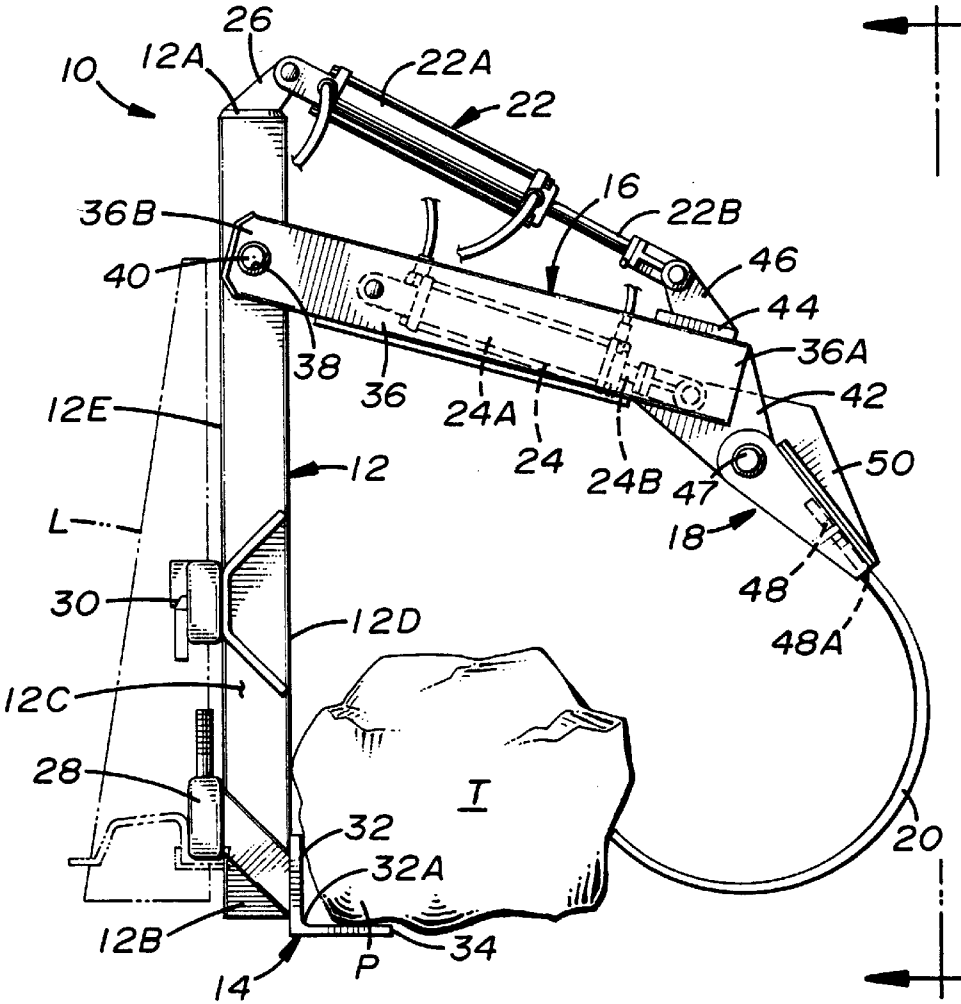
FIG. 5 is a side elevational view of the apparatus showing an object grasped between the support member and pair of tines of the apparatus.

Referring to FIGS. 3 to 5, the apparatus 10 further includes a pair of lower and upper coupling members 28, 30. The lower mounting member 28 is fixedly attached by the use of any suitable means such as by welding or fasteners at the rear side 12E of and transversely disposed relative to the main frame 12 at a location slightly above the lower end 12B of the main frame 12. The upper coupling member 30 is spaced above the lower coupling member 28, extends transversely relative to the main frame 12 and generally parallel to the lower coupling member 28. The upper coupling member 30 is fixedly attached by the use of any suitable means such as by welding or fasteners at the rear side 12E of the main frame at a location between and spaced from the upper and lower ends 12A, 12B of the main frame 12. The upper and lower coupling members 28, 30 are configured and adapted for facilitating easy attaching of the apparatus 10 to and detaching of the apparatus 10 from the lift mechanism L of the material handling vehicle V.

Referring again to FIGS. 1 to 6, the shoe or support member 14 of the apparatus 10 includes an upright portion 32 and a base portion 34. The upright portion 32 is attached by any suitable means such as by the use of welding or fasteners to the front side 12D of the main frame 12 at the lower end 12B thereof and is disposed in a transverse relationship thereto. The upright portion 32 also is disposed below, on the opposite side of the main frame 12 from, and generally parallel to the lower coupling member 28. The base portion 34 is attached to a lower edge 32A of the upright portion 32 and extends outwardly therefrom so as to provide the support member 14 in a generally right-angle L-shaped configuration in cross sectioin. The upright portion 32 has a width and a length approximately the same as the width and length of the base portion 34. The upright portion 32 of the support member 14 is adapted to be placed against an edge portion P of the object T to be grasped while the base portion 34 of the support member 14 which extends outwardly from the lower end 12B of the main frame 12 through a relatively short distance is adapted to be placed under the edge portion P of the object T. By way of example only, the support member 14 can be in the form of a six inch by six inch by one-half inch angle iron.

Figure 6:
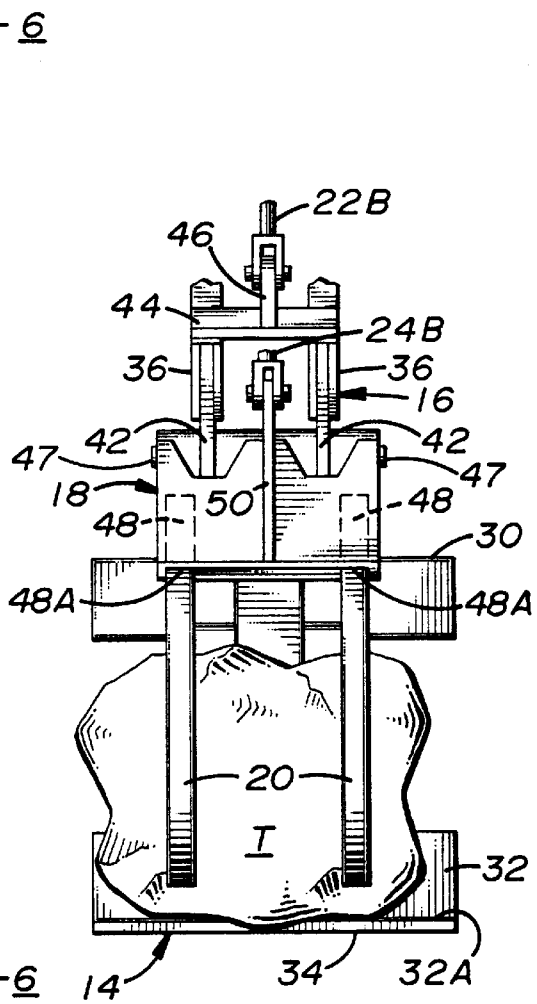
FIG. 6 is an end elevational view of the apparatus on a reduced scale as seen along line 6—6 of FIG. 5.

Referring to FIGS. 2 and 6, the arm member 16 of the apparatus 10 is formed by a pair of elongated links 36 disposed in substantially parallel relation to and laterally spaced apart from one another. The links 36 are substantially identical to one another and rigidly interconnected to one another. By way of example only, the links 36 are spaced apart about six and one-half inches from one another. Each link 36 has opposite outer and inner ends 36A, 36B and a substantially rectangular configuration in longitudinal cross-section and in transverse cross-section. Each link 36 has a hole 38 defined therethrough spaced from and adjacent to the inner end 36B thereof. The main frame 12 also has pins 40 fixedly attached to and extending outwardly from the opposite lateral sides 12C and which extend through the respective holes 38 of the links 36. Thus, the links 36 of the arm member 16 at their inner ends 36B are pivotally mounted on the pins 40. Each link 36 further has a mounting flange 42 mounted at its outer end 36A. The arm member 16 also has a mounting plate 44 with a connector tab 46 thereon which overlies and is rigidly attached to the outer ends 36A of the links 36. The connector tab 46 is disposed between the links 36 and aligned with the tab 26 on the upper end 12A of the main frame 12. By way of example only, each link 36 can be in the form of a two inch by five inch rectangular tube. As can be readily seen in FIGS. 3–5, the arm member 16 extends outwardly from the main frame 12 to the outer ends 36A of the links 36 thereof through a distance substantially greater than the distance the shoe or support member 14 extends from the main frame 12.

Referring to FIGS. 2 to 5, the tine mounting member 18 of the apparatus 10 can have a substantially duckbill-like configuration. The tine mounting member 18 is pivotally mounted by pivotal connections to the outer ends 36A of the links 36 making up the arm member 16. The tine mounting member 18 is particularly pivotally mounted to the mounting flanges 42 on the outer ends 36A of the link 36 of the arm member 16. In such manner, the tine mounting member 18 is pivotally movable independently of the arm member 16. The tine mounting member 18 defines a pair of laterally spaced passageways 48. The passageways 48 are disposed in substantially parallel relation to one another and have an open end 48A and a generally circular configuration. The tine mounting member 18 may be in the form of a one inch flat bar.

Referring to FIGS. 1 to 6, the tines 20 of the apparatus 10 are disposed in substantially parallel relation to one another and are spaced apart from one another. While it is possible to employ only one tine 20, the employment of a pair of the tines 20 is preferred. Each of the tines 20 has a substantially curved longitudinal configuration and a substantially rectangular configuration in transverse cross-section. Each tine 20 is disposed at a location spaced outwardly from the arm member 16 and adjacent to a first side of the pivotal connection 47 of the tine mounting member 18 to the arm member 16. Further, each tine 20 is fixedly mounted to and extends outwardly and downwardly from the tine mounting member 18 with an end portion of each tine 20 being retained within one of the passageways 48 of the tine mounting member 18 in any suitable manner, such as by fasteners. Each tine 20 extends from the open end 48A of the one passageway 48. Each tine 20 is preferably comprised of a spring steel material.

Referring to FIGS. 3 to 6, each of the main and auxiliary actuation mechanisms 22, 24 of the apparatus 10 is preferably a hydraulic cylinder mechanism. Each of the hydraulic cylinder mechanisms includes a cylinder 22A, 24A and a piston rod 22B, 24B. The main actuation mechanism 22 is disposed above the links 36 of the arm member 16 and pivotally mounted to and extends between the tab 26 on the upper end 12A of the main frame 12 and the connector tab 46 on the mounting plate 44 attached across the outer ends 36A of the links 36 of the arm member 16. The main actuation mechanism 22 is extendable and retractable to pivotally move the arm member 16 and the tines 20 therewith vertically through a first arcuate path F relative to the main frame 12 toward and away from the support member 14 and the object B between the arm member 16 and the support member 14. The auxiliary actuation mechanism 24 of the apparatus 10 is disposed below the main actuation mechanism 22 and substantially between the links 36 of the arm member 16 and pivotally mounted to and extends between the arm member 16 near the main frame 12 and a connector flange 50 on the tine mounting member 18. The auxiliary actuation mechanism 24 is also located between the main frame 12 and the pivotal connection 47 of the tine mounting member 18 to the support arm 16 and adjacent to a second side of the pivotal connection 47 being substantially opposite from the first side thereof where the tines 20 are located. The auxiliary actuation mechanism 24 is extendable and retractable to pivotally move the tine mounting member 18 and the tines 20 therewith vertically through a second arcuate path S relative to the arm member 16 toward and away from the support member 14 and the object B between the tines 20 and the support member 14 so that an operator of the vehicle V may hydraulically operate the first and second hydraulic cylinder mechanisms 22, 24 to cause and control pivotal movement of the arm member 16 in relation to the main frame 12 and pivotal movement of the tine mounting member 18 and therewith the tines 20 in relation to the arm member 16. As is clearly apparent in FIG. 5, by the arm member 16 extending a substantially greater distance outwardly from the main frame 12 than the support member 14 extends from the main frame 12, the tines 20 can be positioned at a location spaced forwardly from the support member 14 so as to enable the support member 14 and tines 20 together to grasp and support the object T located therebetween for relocating the object T upon maneuvering of the apparatus 10 by operation of the material handling vehicle without the support member 14 having to extend sufficiently under the object T to alone support the object without assistance from the tines 20.

Thus, by selected actuation of the first and second actuation mechanism 22, 24 and operation of the material handling vehicle V and of the lift mechanism L mounted thereon, the apparatus 10 when attached to the vehicle V can be maneuvered toward a position adjacent to the object T, as shown in FIG. 1 where the support member 14 is brought into engagement against and under a near side of the object T relative to the vehicle V. The arm member 16 can then be hydraulically lowered to a point where the ends of the tines 20 contact a far side of the object T relative to the vehicle V. Then, the tine mounting member 18 and tines 20 therewith are hydraulically pivoted downward and toward the support member 14 such that the tines 20 apply pressure to the far side of the object T as the support member 14 applies pressure to the near side of the object T so that the tines 20 and support member 14 together grasp the object T therebetween. The lift mechanism L is then operated in a well-known manner to lift the apparatus 10 and the grasped object T for movement to and placement at a desired location upon further operation of the material handling vehicle V. Once the desired location is reached, the lift mechanism L is again operated to lower the apparatus 10 and grasped object T in order to precisely place the object T at that position. It will be observed that only the base portion of the support member may actually extend a short distance under the object T so that there is only minimal interference by the apparatus 10 with the placement of the object T at a desired location on the ground or any other desired surface. The tines 20 and support member 14 together function in a way which substantially resembles two fingers and a thumb of a hand grasping the object T as it is lifted and separated from a pile thereof.

The apparatus 10 is a compact, light weight attachment that combines dexterity with brute force in carrying out its lifting and placing operations. The tines 20 allow the operator to sort through, choose the desired position, and then pick up and carry away a wide variety of different objects without gouging or disturbing their surfaces, limited only by the hydraulic lifting capabilities of the vehicle V to which the apparatus 10 is attached. The spring steel tines will resiliently flex to the contour of the object in the grasp or grip of the apparatus 10. The object can easily be stacked, placed on a truck bed or simply stockpiled by the apparatus 10 without the apparatus 10 dumping the object or struggling to get from under it.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. An apparatus for grasping odd-shaped objects to relocate the same, comprising:

(a) an elongated upright main frame having opposite upper and lower ends, said main frame having means for attaching said main frame to a material handling vehicle for maneuvering said main frame between different heights and locations by operation of the material handling vehicle;

(b) a support member mounted to said main frame adjacent to said lower end thereof and being adapted for engaging an edge of an object, said support member extending outwardly from said lower end of said main frame through a first distance;

(c) an arm member having spaced apart inner and outer ends and at said inner end being pivotally mounted to said main frame at a location spaced above said support member and closer to said upper end than to said lower end of said main frame so as to undergo pivotal movement relative to said main frame, said arm member extending outwardly from said main frame to said outer end of said arm member through a second distance substantially greater than said first distance of said support member;

(d) a tine mounting member mounted to said outer end of said arm member by a pivotal connection therewith so as to undergo pivotal movement relative to and independently of said arm member;

(e) at least one tine having inner and outer ends and a substantially curved configuration, said tine being mounted at said inner end to said tine mounting member at a location spaced outwardly from said outer end of said arm member and disposed adjacent to and extending outwardly from a first side of said pivotal connection of said tine mounting member to said arm member, said tine extending outwardly and downwardly from said tine mounting member to said outer end of said tine and being movable with said tine mounting member such that said tine can be positioned at a location spaced forwardly from said support member so as to enable said support member and said outer end of said tine together to grasp and support an object located therebetween for relocating the object upon maneuvering of said apparatus by operation of the material handling vehicle without said support member having to extend sufficiently under the object to alone support the object without assistance from said tine;

(f) means for respectively pivotally moving said arm member and said tine mounting member therewith relative to said main frame and said support member mounted thereto and for pivotally moving said tine mounting member and said tine therewith relative to said arm member and said main frame and said support member mounted thereto through respective first and second arcuate paths toward and away from said main frame and said support member mounted thereto such that said support member and said outer end of said tine together may be brought into engagement with and thereby together grasp and support the object at spaced rearward and forward locations thereon for relocating the object upon maneuvering of said apparatus by operation of the material handling vehicle, said pivotally moving means being located between said main frame and said pivotal connection of said tine mounting member to said arm member and disposed adjacent to a second side of said pivotal connection of said tine mounting member to said arm member being substantially opposite from said first side of said pivotal connection where said tine is located.

2. The apparatus of claim 1 further comprising:

a pair of said tines being spaced apart from one another and mounted to and extending outwardly and downwardly from said tine mounting member.

3. The apparatus of claim 1 wherein said tines extend in substantially parallel relationship to one another.

4. The apparatus of claim 1 wherein said pivotally moving means includes a main actuation mechanism pivotally mounted to said main frame and to said arm member and being extendable and retractable to pivotally move said arm member and tine mounting member therewith vertically through said first arcuate path relative to said main frame and said support member mounted thereto and toward and away from said main frame and said support member.

5. The apparatus of claim 4 wherein said main actuation mechanism is a hydraulic cylinder mechanism.

6. The apparatus of claim 1 wherein said pivotally moving means includes an auxiliary actuation mechanism pivotally mounted to said arm member and to said tine mounting member and being located between said main frame and said pivotal connection of said tine mounting member to said support arm and adjacent to said second side of said pivotal connection substantially opposite from said first side of said pivotal connection where said tine is located, said auxiliary actuation mechanism being extendable and retractable to pivotally move said tine mounting member and tine therewith vertically through said second arcuate path relative to said arm member and said main frame and said support member mounted thereto and toward and away from said main frame and said support member.

7. The apparatus of claim 6 wherein said auxiliary actuation mechanism is a hydraulic cylinder mechanism.

8. The apparatus of claim 1 wherein said support member includes:

an upright portion mounted to said main frame and disposed in a transverse relationship thereto adjacent to said lower end of said main frame; and a base portion attached to said upright portion and extending outwardly therefrom so as to provide said support member in a substantially L-shaped configuration in cross-section such that said upright portion can be placed against an edge of the object to be grasped and said base portion can be placed under the edge of the object to be lifted.

9. The apparatus of claim 1 wherein:

said main frame has opposite lateral sides; and said arm member has a pair of interconnected links disposed in substantially parallel relation to and spaced apart from one another, each of said links having opposite outer and inner ends and being pivotally mounted at said inner end to one of said opposite lateral sides of said main frame at a location closer to said upper end than to said lower end of said main frame.

10. The apparatus of claim 9 wherein said tine mounting member is pivotally mounted to said outer ends of said links of said arm member.

11. The apparatus of claim 1 wherein said means for attaching said main frame to the material handling vehicle includes a pair of upper and lower coupling members, said lower coupling member being fixedly mounted to said main frame at a location slightly higher than and on an opposite side of said main frame from said support member, said upper coupling member being spaced above said lower coupling member and fixedly mounted to said main frame at a location between and spaced from said lower and upper ends of said main frame, said upper and lower coupling members being adapted for attaching said apparatus to a lift mechanism of the material handling vehicle.

12. An apparatus for grasping odd-shaped objects to relocate the same, comprising:

(a) an elongated upright main frame having opposite upper and lower ends, said main frame having means for attaching said main frame to a material handling vehicle for maneuvering said main frame between different heights and locations by operation of the material handling vehicle;

(b) a support member mounted to said main frame adjacent to said lower end thereof and being adapted for engaging an edge of an object, said support member extending outwardly from said lower end of said main frame through a first distance;

(c) an arm member having spaced apart inner and outer ends and at said inner end being pivotally mounted to said main frame at a location spaced above said support member and closer to said upper end than to said lower end of said main frame so as to undergo pivotal movement relative to said main frame, said arm member extending outwardly from said main frame to said outer end of said arm member through a second distance substantially greater than said first distance of said support member, said arm member being formed by a pair of elongated rigid links laterally spaced apart from one another;

(d) a tine mounting member mounted to said outer end of said arm member by a pivotal connection therewith so as to undergo pivotal movement relative to and independently of said arm member;

(e) a tine structure having inner and outer ends and a substantially curved configuration, said tine structure being mounted at said inner end thereof to said tine mounting member at a location spaced outwardly from said outer end of said arm member and disposed adjacent to and extending outwardly from a first side of said pivotal connection of said tine mounting member to said arm member, said tine structure extending outwardly and downwardly from said tine mounting member to said outer end of said tine structure and being movable with said tine mounting member such that said tine structure can be positioned at a location spaced forwardly from said support member so as to enable said support member and said outer end of said tine structure together to grasp and support an object located therebetween for relocating the object upon maneuvering of said apparatus by operation of the material handling vehicle without said support member having to extend sufficiently under the object to alone support the object without assistance from said tine structure;

(f) a main actuation mechanism disposed above said links of said arm member and being pivotally mounted to said main frame and to said arm member and being extendable and retractable to pivotally move said arm member and tine mounting member therewith vertically through a first arcuate path relative to said main frame toward and away from said main frame and said support member mounted thereto; and (g) an auxiliary actuation mechanism disposed below said main actuation mechanism and substantially between said links of said arm member and being pivotally mounted to said arm member and to said tine mounting member and located between said main frame and said pivotal connection of said tine mounting member to said support arm and adjacent to a second side of said pivotal connection substantially opposite from said first side of said pivotal connection where said tine structure is located, said auxiliary actuation mechanism being extendable and retractable to pivotally move said tine mounting member and tine structure therewith vertically through a second arcuate path relative to said arm member toward and away from said main frame and said support member mounted thereto such that said main and auxiliary actuation mechanisms may be operated to cause and control pivotal movement of said arm member in relation to said main frame and pivotal movement of said tine mounting member and therewith said tine structure in relation to said arm member such that said apparatus when attached to the material handling vehicle is maneuverable by operation of the material handling vehicle to a position adjacent to the object, said support member being engage able against and under a near side of the object, said arm member being lower able to a point where said outer end of said tine structure is spaced outwardly from said support member and contacts a far side of the object and such that said tine mounting member and tine structure therewith can be pivoted such that said outer end of said tine structure applies pressure to the far side of the object so that said tine structure and support member together can grasp and lift the object for movement to and placement at a desired location upon further operation of the material handling vehicle without said support member having to extend sufficiently under the object to alone support the object without assistance from said tine structure.

13. The apparatus of claim 12 wherein said tine structure includes a pair of tines laterally spaced apart from one another and extending in a substantially parallel relationship to one another.

14. The apparatus of claim 12 wherein said main actuation mechanism is a first hydraulic cylinder mechanism.

15. The apparatus of claim 14 wherein said auxiliary actuation mechanism is a second hydraulic cylinder mechanism.

16. The apparatus of claim 12 wherein said support member includes:

an upright portion mounted to said main frame and disposed in a transverse relationship thereto adjacent to said lower end of said main frame; and a base portion attached to said upright portion and extending outwardly therefrom so as to provide said support member in a substantially L-shaped configuration in cross-section such that said upright portion can be placed against an edge of the object to be grasped and said base portion can be placed under the edge of the object to be lifted.

17. The apparatus of claim 12 wherein:

said main frame has opposite lateral sides; and said pair of links of said arm member are disposed in substantially parallel relation to and spaced apart from one another, each of said links having opposite outer and inner ends and being pivotally mounted at said inner end to one of said opposite lateral sides of said main frame at a location closer to said upper end than to said lower end of said main frame.

18. The apparatus of claim 17 wherein said main actuation mechanism is a first hydraulic cylinder mechanism being pivotally connected at one end to said outer ends of said links of said arm member and at an opposite end to said upper end of said main frame.

19. The apparatus of claim 17 wherein said tine mounting member is pivotally mounted to said outer ends of said links of said arm member.

20. The apparatus of claim 12 wherein said means for attaching said main frame to the material handling vehicle includes a pair of upper and lower coupling members, said lower coupling member being fixedly mounted to said main frame at a location slightly higher than and on an opposite side of said main frame from said support member, said upper coupling member being spaced above said lower coupling member and fixedly mounted to said main frame at a location between and spaced from said lower and upper ends of said main frame, said upper and lower coupling members being adapted for attaching said apparatus to a lift mechanism of the material handling vehicle.

* * * * *